US005810684A

United States Patent [19]

Öhman

[11] Patent Number: 5,810,684

[45] Date of Patent: Sep. 22, 1998

[54] BLADE FOR CLUB SHAFT

[76] Inventor: Gerth Öhman, Box 30, S-892 21 Domsjö, Sweden

[21] Appl. No.: 786,990

[22] Filed: Jan. 23, 1997

[30] Foreign Application Priority Data

Feb. 16, 1996 [SE] Sweden ..... 9600560

[51] Int. Cl.[6] ..... A63B 59/12

[52] U.S. Cl. ..... 473/563

[58] Field of Search ..... 473/563, 189

[56] References Cited

U.S. PATENT DOCUMENTS

| | | | |
|---|---|---|---|
| D. 244,790 | 6/1977 | Carlson et al. | 473/563 |
| 4,076,240 | 2/1978 | Haddad | 473/563 |
| 5,127,649 | 7/1992 | Carbonero | 473/563 |
| 5,429,352 | 7/1995 | Leclerc | 473/563 |
| 5,511,776 | 4/1996 | Huru | 473/563 |

FOREIGN PATENT DOCUMENTS

| | | | |
|---|---|---|---|
| 1383949 | 2/1975 | Canada | 473/189 |
| 2717 | 2/1909 | United Kingdom | 473/189 |
| 94021334 | 9/1994 | WIPO | 473/189 |
| WO94/21334 | 9/1994 | WIPO . | |

*Primary Examiner*—Mark S. Graham
*Attorney, Agent, or Firm*—Fasth Law Office; Rolf Fasth

[57] ABSTRACT

The present invention is a blade 1 for a club shaft including a blade 1 comprising different guiding elements such as a ball rolling line 7 that guides the ball to at least one aperture 16 or between two different apertures 16, 17 that make it easier, when the ball is in the aperture to drive, dribble, cover and shoot. The apertures 16, 17 provide for a lower air resistance and are optimal for shooting because the ball is always on the right spot on the club. This results in faster and more powerful shots. The blade 1 also provides for a defensive technical feature through the blocking protrusion 14 which gives the club shaft and the blade the right height above a support layer when the club is laid down thereon for covering a shot. Finally, the blade 1 also provides for the possibility of being used for advertising or team display since the apertures 16, 17 can be provided with a resilient advertising material such a rubber based sheet material. Naturally, it is also possible in a forming tool, via injection, make the resilient material homogenous with the blade 1 that can be made of a material that is stiff.

10 Claims, 1 Drawing Sheet

FIG. 1a
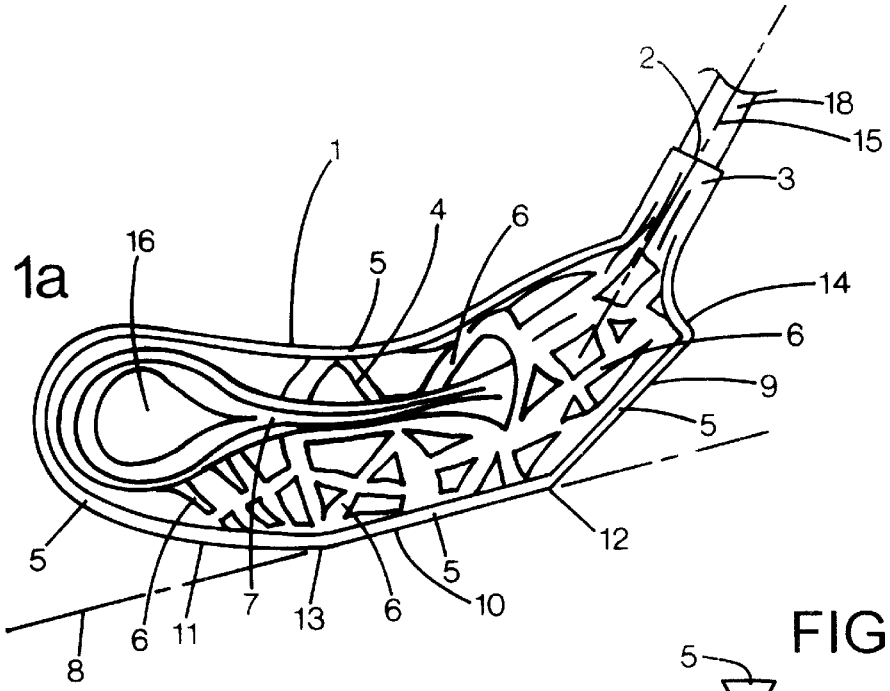
FIG. 1b
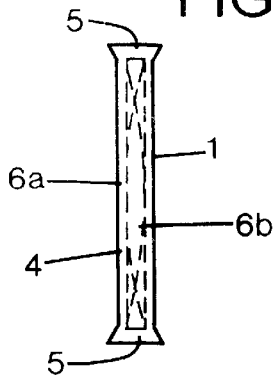
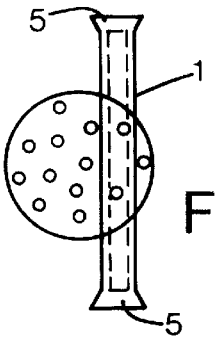
FIG. 1c
FIG. 2
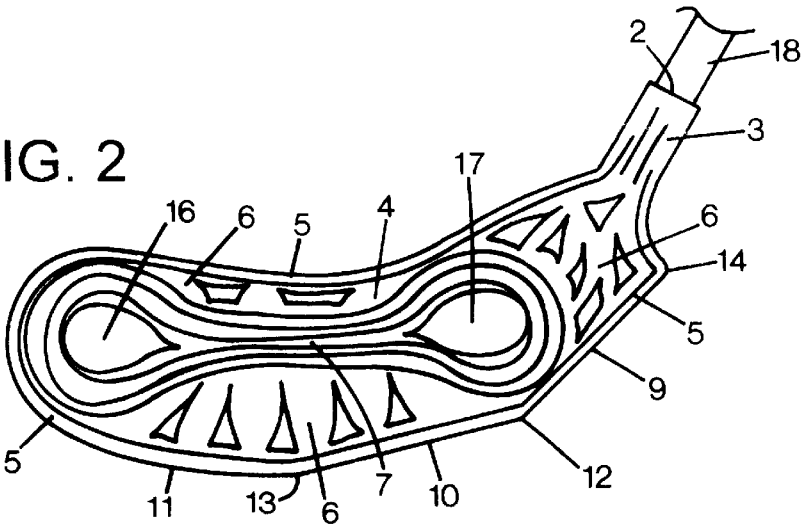

BLADE FOR CLUB SHAFT

TECHNICAL FIELD

The blade is adapted to be used for indoor bandy and field hockey.

CURRENT TECHNOLOGY

Blades that are used for indoor bandy and field hockey, preferably indoor bandy, have a design that is based on rules for the equipment. Blades that have a continuous radius can here be found, that is, the blades have an evenly distributed curved shape. Furthermore, there are blades with increasing and decreasing radius. There are also blades that have two relatively straight sole section with an angular corner portion disposed therebetween so that they together form a curve shaped blade. The upper portion of these blades, having a straight sole section, is often evenly curved.

The blades may be heated and laterally bent to form a hook. In this way, a is centripetal force may be obtained on the ball so that it accelerates i.e. obtains a higher speed.

To provide the ball with an even higher speed, protrusions are formed on the blade so that the ball may climb up on the blade during the shot to obtain a higher speed. The protrusion may also be used to press down the ball against the floor or the ground to bend the shaft which makes the shot faster and harder. Finally, the edge of the blades have been made relatively round, that is ball shaped, to provide for better aim of the ball.

Any cavities in the blade are determined by the pattern on the blade. The pattern also provides strength and flexibility depending on how the pattern is designed, i.e. which pattern is used.

THE TECHNICAL PROBLEM

The blades are made better and better and the shots are becoming more powerful. However, this results in reduced precision. The ball tends to roll out along the blade during the shot. The ball is then often positioned on a portion of the blade that is not the most effective position i.e. where the highest shot velocity is obtained while maintaining good precision. This means that the user of the blade must practice an unlimited amount of options where the ball may be positioned during the moment of the shot.

During dribbling the blade is the most important tool to bring the ball along with the movements of the body. Highly bent blades, i.e. blades having a distinct hook shape, provides for good dribbling in one direction but not in the opposite direction. Because dribbling must be done in both directions, it is desirable to make the blade as straight as possible while maintaining the ability to shoot powerfully. The risk of injury is also reduced because the bend of the blade, i.e. the hook, does not get caught as easily on team players or on players from the opposing team. It is therefore a technical object to provide a blade that enables dribbling so that the ball may be directed in both directions while maintaining an optimal precision.

Another technical object is to provide a blade that may be used both offensively when shooting and defensively when covering or blocking shots. In this way, full backs are able to block, cover and also shot powerfully with optimal precision.

THE SOLUTION TO THE PROBLEM

The technical problem is solved, in other words, by providing a technical design of the blade so that the ball when shooting or during dribbling is rolled into a predetermined position on the blade. This predetermined position is an aperture indication defined in the blade including a certain cavity formed in the blade.

The rolling into the predetermined position of the ball can change to a rolling out of the predetermined position by, for example, turning the shaft so that the blade is disposed at an angle.

The ball is secured in a predetermined position that provides the best effectiveness when shooting.

The ball can also be secured in this predetermined position and be secured therein during dribbling.

The sole portion of the blade has at least two angular corner portions to permit the blade and the shaft to be adjusted for blocking, covering, shooting and dribbling.

The ball can be secured in more than one predetermined position if so desired. This is achieved by providing the blade with a rolling guidance device along the blade and at least one additional predetermined position is formed on the blade.

ADVANTAGES

The above described solution to the technical problem provides for a substantial technical advancement of today's existing technology. The blades currently available do, when the blades are bent, provide for high shooting velocities. However, the increased shooting velocity is at the expense of reduced ability to dribble and shoot and to dribble in the other opposite direction. The aperture indication provides the technical effect that the point of gravity of the ball is closer to the elongate line of balance of the blade.

Because the ball falls into the blade the precision is improved. The ball does not roll out of this position. The aperture in the blade also provides for a lower air resistance when slap shooting.

By taking advantage of protrusions, through more than one angle and the sole of the blade, a higher position of the shaft relative the ground level can be obtained when the club is laid down parallel against a support to cover for a shot. The protrusion is selected to be equivalent to half the diameter of the ball or slightly more so that the ball does not bounce over the shaft when the ball hits the shaft, as is described in today's technology.

The present invention also provides many other advantages. The aperture, among other tings, makes it possible for stores to hang the blades and clubs. It has been calculated that the apertures also result in that the weight is reduced by 10–20 percent on average. This means that material that corresponds to every fifth or tenth blade is saved.

Field hockey and indoor bandy have existed for more than twenty years. Despite rapidly increasing technical developments where the person of ordinary skill in the art has conducted intensive research and development, he has not been able to solve this problem. The present invention is therefore adding new technology to this product.

BRIEF DESCRIPTION OF THE DRAWINGS

The present invention is going to be described with reference to:

FIG. 1*a* showing a side view of the blade of the present invention.

FIG. 1*b* showing a rear view of the same blade.

FIG. 1*c* showing a front view of the same blade having a ball disposed in the aperture of the blade.

FIG. 2 showing an alternative embodiment of the blade of FIGS. 1*a* and 1*b*.

DETAILED DESCRIPTION

The present invention is a blade represented by reference numeral 1 having an attachment mechanism 2, a shaft device 3 and a blade member 4. The blade member 4 has stiffened outer edges 5 and inner segments 6. The number of segments may be selected depending on which strength and resiliency that is desired of the blade. The blade member has a horizontal ball rolling line 7 along which the ball may roll and move during dribbling and acceleration when shooting. The rolling line 7 extends along the longitudinal direction of the blade and is a groove that is shaped to matchingly receive the roundness of the ball. In this way, the ball glides or rolls along this groove to or from the apertures 16 and 17. The apertures are going to be described in more detail below. The horizontal ball rolling line 7 is also a support surface when slap shooting. This means that the distance from a support layer 8 to the center of the ball rolling line 7 is two to five centimeters, preferably three and a half centimeters.

The blade member 4 has at least two lower surfaces namely blocking surface 9 and a shooting and passing surface 11. Between these surfaces the sole portion of the blade member 4 may be bent. The blade can also be provided with a dribbling and shooting surface 10. In this case, the blade member 4 has two angular corner sections 12 and 13. The surfaces 9, 10 and 11 do not have to be completely straight but can also be slightly bent.

The blocking surface 9 has a blocking protrusion 14 extending from the shaft socket 3. The perpendicular distance from the blocking protrusion 14 to the center line 15 of the shaft socket 3 is two to six centimeters, preferably three and a half centimeters.

The blade member 4 has at least one aperture 16 at its distal end. The aperture constitutes the end of the rolling that the ball does along the ball rolling line 7. The aperture can be geometrically shaped in a wide variety of ways. However, the ball should fall in via the side edges 6*a* and 6*b* of the segments 6. Regardless of the shape of the aperture 16 the depth of the penetration of the ball should not be greater than three and a half centimeters.

The blade member 4 may also be provided with an additional aperture indication 17. This additionally aperture 17 provides for an alternative possibility to shoot with a high precision when the club is held far away from the body. Technically is it possible to quickly change from blocking and covering via the block protrusion 14 to a quick shot via the additional aperture 17 without having to move the blade 1 closer to the body. In this situation, the angular corner 12 may be used to increase the velocity to be compared with a change of the leverage of the force.

The normal use of the blade 1 is that a player is using the shooting and passing surface 11 and, if available on the blade, the player is using the dribbling and shooting surface 10 to drive, dribble and shoot the ball. When playing defensively, the same surfaces may be used for covering in addition to the blocking surface 9. The shaft 18 of the blade may be lined up with the support layer 8 so that the blocking protrusion 14 is in contact with the layer. In this way, a much larger are is blocked. The opponent is forced to shoot high. The invention has above been described in detail. The detailed description also include the figures that are attached to this application and the patent claims and abstract that are enclosed.

While the present invention has been described in accordance with preferred compositions and embodiments, it is to be understood that certain substitutions and alterations may be made thereto without departing from the spirit and scope of the following claims.

I claim:

1. A blade in combination with a ball for driving, dribbling and shooting the ball in field hockey or bandy, comprising:

a blade member having a first and a second end portion, the blade member having a first opening defined therein at the first end portion thereof so that the first opening extends through the blade member, the blade member having a bottom portion;

a ball that is dimensioned to partially penetrate the first opening when the ball engages the first opening;

an elongate club shaft;

an attachment mechanism for attaching the blade member to the club shaft; and an elongate rolling surface disposed along the blade member;

a bottom surface disposed at the bottom portion of the blade member, the rolling surface being substantially parallel to the bottom surface; and a second opening defined at a second end portion of the blade member; the rolling surface extending between the first opening and the second opening, the rolling surface having a shallow elongate cavity defined therein that extends between the first and second openings so that each end of the elongate cavity diverges into the first and second openings, the first and second openings having a diameter and the elongate cavity having a width that is less than the diameter of the first and second openings.

2. A blade according to claim 1 wherein the blade member has at least one ball rolling line defined therein to permit the ball to roll along the ball rolling line into and out of the first opening.

3. A blade according to claim 2 wherein the ball rolling line extends between the first opening and the second opening.

4. A blade according to claim 1 wherein the first and second opening each has a diameter that permits a maximum insertion depth of 3.5 centimeters of the ball and the first end has a curved outer edge portion having a diameter of about 5 centimeters.

5. A blade in combination with a ball for driving, dribbling and shooting the ball in field hockey or bandy, comprising:

a blade member having a first and a second end portion, the blade member having a first opening defined therein at the first end portion thereof so that the first opening extends through the blade member;

a ball that is dimensioned to partially penetrate the first opening when the ball engages the first opening;

an elongate club shaft; and an attachment mechanism for attaching the blade member to the club shaft;

a second opening defined in the blade member so that the second opening extends through the blade member; and the first or second opening being covered by a resilient material, the resilient material having a resiliency that permits partial penetration of the ball when the ball hits either the first or the second opening.

6. A blade according to claim 5 wherein the resilient material is provided with a text or a picture.

7. A blade according to claim 5 wherein the resilient material is integrally formed with the blade member.

8. A blade according to claim 5 wherein the blade member has a blocking surface and a shooting/passing surface so that the blocking surface is sloping relative to the shooting/passing surface and a corner section is disposed between the blocking surface and the shooting/passing surface.

9. A blade according to claim 8 wherein the blade member has a dribbling surface disposed between the blocking surface and the shooting/passing surface so that the dribbling surface is sloping relative to the blocking surface and relative to the shooting/passing surface and a first corner section is disposed between the dribbling surface and the blocking surface and a second corner section is disposed between the dribbling surface and the shooting/passing surface.

10. A blade according to claim 5 wherein the blade member has a blocking protrusion disposed at the second end portion of the blade member and the club shaft has a center line that is disposed about two to six centimeters from the block protrusion.

* * * * *